US010814945B2

(12) United States Patent
Chaney et al.

(10) Patent No.: US 10,814,945 B2
(45) Date of Patent: Oct. 27, 2020

(54) LIFE RAFT SYSTEM

(71) Applicants: Robert Chaney, Bowser (CA); Darren Berrecloth, Parksville (CA); Ian Dellert, Delta (CA); Alex Carey, Errington (CA); Travis Chaney, Bowser (CA); Darren Terhune, Ucluelet (CA); Sean Raymond Schlueter, Gilbert, AZ (US)

(72) Inventors: Robert Chaney, Bowser (CA); Darren Berrecloth, Parksville (CA); Ian Dellert, Delta (CA); Alex Carey, Errington (CA); Travis Chaney, Bowser (CA); Darren Terhune, Ucluelet (CA); Sean Raymond Schlueter, Gilbert, AZ (US)

( * ) Notice: Subject to any disclaimer, the term of this patent is extended or adjusted under 35 U.S.C. 154(b) by 0 days.

(21) Appl. No.: 16/676,286

(22) Filed: Nov. 6, 2019

(65) Prior Publication Data

US 2020/0108901 A1 Apr. 9, 2020

Related U.S. Application Data

(63) Continuation-in-part of application No. 15/836,731, filed on Dec. 8, 2017, now abandoned.

(51) Int. Cl.
*B63C 9/04* (2006.01)
*B63C 9/20* (2006.01)

(52) U.S. Cl.
CPC ..... *B63C 9/04* (2013.01); *B63C 9/20* (2013.01); *B63C 2009/042* (2013.01)

(58) Field of Classification Search
CPC ..... B63C 9/04; B63C 2009/042; B63C 2009/044
USPC ..... 441/40, 42
See application file for complete search history.

(56) References Cited

U.S. PATENT DOCUMENTS 3,132,357 A * 5/1964 Fenster ..... B63C 9/22 114/365
4,124,911 A * 11/1978 Wildhagen ..... B63B 23/62 114/367
4,633,802 A * 1/1987 Olsen ..... B63C 9/22 114/367
RE32,560 E 12/1987 Givens
(Continued)

FOREIGN PATENT DOCUMENTS

CN 202320740 7/2012
CN 206171759 5/2017

*Primary Examiner* — Anthony D Wiest
(74) *Attorney, Agent, or Firm* — Runyan Law; Charles Runyan

(57) ABSTRACT

A life raft system including a life raft assembly including a mounting bracket having a base and an awning, an upper lateral support having a latching mechanism and deployment cable, a lower lateral support comprising a hinge-member, a self-inflatable raft having a housing, an inflator, an inflator cable, and a raft securing cable, and a cover chute. The life raft system is a residential and commercial life saving device for urban and rural area homes as well as commercial building structures that could be at risk to rising flood waters. The device may be mounted to a structure such as a home or building as a precaution. The device provides a family or group of people with the ability to flee to higher ground when disaster occurs, preventing loss of life and offering a safe exit from an affected area.

20 Claims, 5 Drawing Sheets

(56) References Cited

U.S. PATENT DOCUMENTS

| | | | | |
|---|---|---|---|---|
| 4,747,797 | A * | 5/1988 | Hindle | B63C 9/04<br>441/38 |
| 6,375,529 | B1 | 4/2002 | Infante | |
| 7,681,515 | B1 * | 3/2010 | Apple | B63C 9/22<br>114/365 |
| 2007/0256719 | A1 | 11/2007 | Hill | |
| 2012/0282829 | A1 * | 11/2012 | Thomas | B63C 9/04<br>441/38 |
| 2013/0008367 | A1 * | 1/2013 | Michaud | B63C 9/22<br>114/365 |

* cited by examiner

LIFE RAFT SYSTEM

CROSS-REFERENCE TO RELATED APPLICATION(S)

The present application is a Continuation-in-Part and is related to and claims priority to pending U.S. Non-Provisional patent application Ser. No. 15/836,731 filed Dec. 8, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of safety devices and more specifically relates to a natural disaster survival device.

2. Description of Related Art

A natural disaster is a major adverse event resulting from natural processes of the earth including floods, hurricanes, tornadoes, volcanic eruptions, earthquakes, tsunamis, and other geologic processes. A natural disaster can cause loss of life or property damage, and typically leaves some economic damage in its wake, the severity of which depends on the affected population's resilience or ability to recover and also on the infrastructure available. A flood is an overflow of water that 'submerges' land. During unfortunate circumstances such as a flood or flooding from hurricane aftermath, home and human populated structure inhabitants often find themselves on their roof waiting to be rescued as flood waters rise. Floods take many lives and no effective safety devices exist to help survive a flood. A suitable solution is desired.

U.S. Pat. No. 6,375,529 to Marisa Infante relates to a reversible life raft and method therefor. The described reversible life raft and method therefor includes an inflatable, reversible life raft with a raft body including upper and lower inflatable, peripherally disposed bladders defining a closed geometric shape. The raft body also includes upper and lower inflatable masts in pneumatic communication with the upper and lower bladders, respectively. A floor closes the geometric shape between the upper and lower bladders. The upper and lower masts support upper and lower canopies, respectively. The upper canopy forms an upright, above-water enclosure to protect survivors from the elements. The lower canopy forms an underwater ballast beneath the floor of the raft, stabilizing the life raft. The reversible life raft is equipped with a reversible, collapsible ladder attached to an exterior portion of the two stacked bladders, and is equipped with two reversible ballast pouches mounted to an exterior portion of the two stacked bladders opposite the ladder. A method for establishing a reversible life raft for survivors in a body of water is also included.

BRIEF SUMMARY OF THE INVENTION

In view of the foregoing disadvantages inherent in the known safety devices art, the present disclosure provides a novel life raft system. The general purpose of the present disclosure, which will be described subsequently in greater detail, is to provide a life support raft with deployment for providing a safety device during times of flooding. The device is mountable to a building structure.

A life raft system is disclosed herein. The life raft system includes a life raft assembly, a mounting bracket having a base, a fold-down hinged cover deployment chute, a chute deployment cable, an inflator deployment cable, a securing cable, and a self-inflatable raft having a housing and an inflator. The life raft system is configured to mount to a structure in an elevated position above ground. The fold-down cover is hinged at a bottom section of the base. The self-inflatable raft is configured within a housing and comprises the inflator. The self-inflatable raft assembly comprising a housing, the inflator, the inflator deployment cable, and securing cable, sit loose between the base and fold-down hinged cover in a pre-deployed state with the external end of the inflator deployment cable secured to the base and the internal end secured to the inflator and the external end of the securing cable secured to the base and the internal end secured to the raft anchor point. The chute deployment cable is secured to the latching mechanism located at the top of the base that secures the fold-down hinged cover chute in the up position. The other end of the chute deployment cable extends downward to the ground or upward to the house or structure roof or combination thereof.

The fold-down hinged cover deployment chute when released, releases the top of the fold-down hinged cover deployment chute and allows the fold-down hinged cover deployment chute to pivot about a bottom hinge thus deploying the raft. The inflator is activated when the deployment cable is pulled by the self-inflatable raft when it is ejected. The housing may be flexible. The housing further encases safety-items for emergency use such as a life straw, a weather proof lighter, a whistle, and a small led flashlight. The device may be mounted to a structure and provide a lifesaving life raft system to prevent people from becoming stranded on roofs.

A kit is also disclosed herein including a set of instructions, a self-inflatable raft, a plurality of cables, a mounting bracket, and a plurality of fasteners.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a life raft system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a safety device and more particularly to a life raft system as used to improve the practical use and efficiency of rafts during natural disasters.

Generally, the life raft system is a residential life saving device for urban and rural area homes that could be at risk to rising flood waters. The life raft system can also be used for any human populated structures. The primary purpose is to save more lives in the event of a catastrophe or natural disaster. The device may be concealed under a gable end of a house or structure or where a homeowner deems appropriate. This device is a precautionary measure when a flood, hurricane, or tsunami strikes. The device provides a family or group of people with the ability to flee to higher ground when disaster occurs, preventing loss of life and offering a safe exit from affected area(s). The life raft system is equipped with state-of-the-art survival components, the raft inhabitants have the ability to provide basic medical aid to another human, decontaminate a small amount of water for ingestion, and signal potential rescuers or rescues.

The device includes a base which may be mounted to a structure using a plurality of pre-drilled mounting holes. The base may further include a cross section having pre-drilled mounting holes for added structural integrity. The base may further include a latching mechanism to secure the cover chute and may also include a cover chute hinge. A cover chute is secured at the top to the base latching mechanism and is hinged at the bottom to the base hinge. The base may include a plurality of cables for raft deployment, inflator activation, and raft securing after deployment. LED light are included to allow for vision at night to access in the dark. The inflator of the invention comprises pressurized carbon dioxide gas housed in a gas canister as an inflation means that is released by pulling the inflator cable thus releasing the pressurized carbon dioxide gas into said life raft buoyancy chambers.

Figure 1:
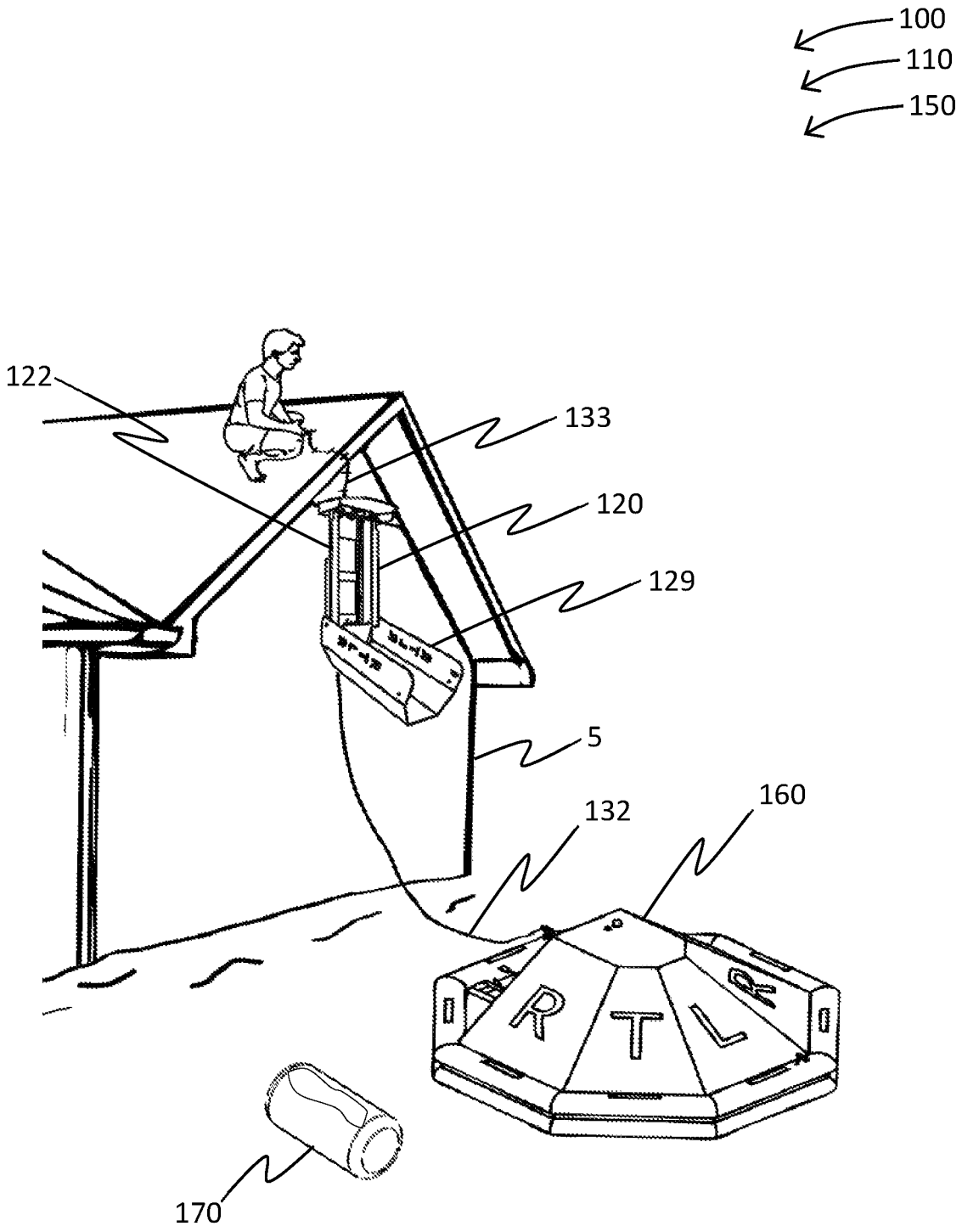
FIG. 1 is a perspective view of the life raft system during an 'in-use' condition, according to an embodiment of the disclosure.

Referring now more specifically to the drawings by numerals of reference, there is shown in FIGS. 1-5, various views of a life raft system 100. FIG. 1 shows a life raft system 100 during an 'in-use' condition 150, according to an embodiment of the present disclosure. As illustrated, the life raft system 100 may include a life raft assembly 110 a mounting bracket 120 having a base 122, upper lateral supports 124 comprising a latching mechanism 126, and lower lateral supports 128 comprising a hinge-member or lower hinge points 130, a self-inflatable raft 160 having a housing 170 and an inflator 164. The life raft system 100 comprises the life raft assembly 110 the mounting bracket 120 and the self-inflatable raft 160. The mounting bracket 120 comprises the base 122, upper lateral supports 124, lower lateral supports 128, and deployment cable 133 in functional combination, and are configured to mount to a structure 5 via a plurality of fasteners 166. The mounting bracket 120 is preferably aluminum or other suitable material. The upper lateral supports 124 comprising latching mechanism 126, and lower lateral supports 128 comprising a hinge-member 130, extend from the base 122 and support and secure the cover chute 129 which houses the self-inflatable raft 160 comprising an inflator cable 131 and a raft securing cable 132 in a ready for use condition. The self-inflatable raft 160 provides a safety device for aiding in survival during flooding.

Figure 2:
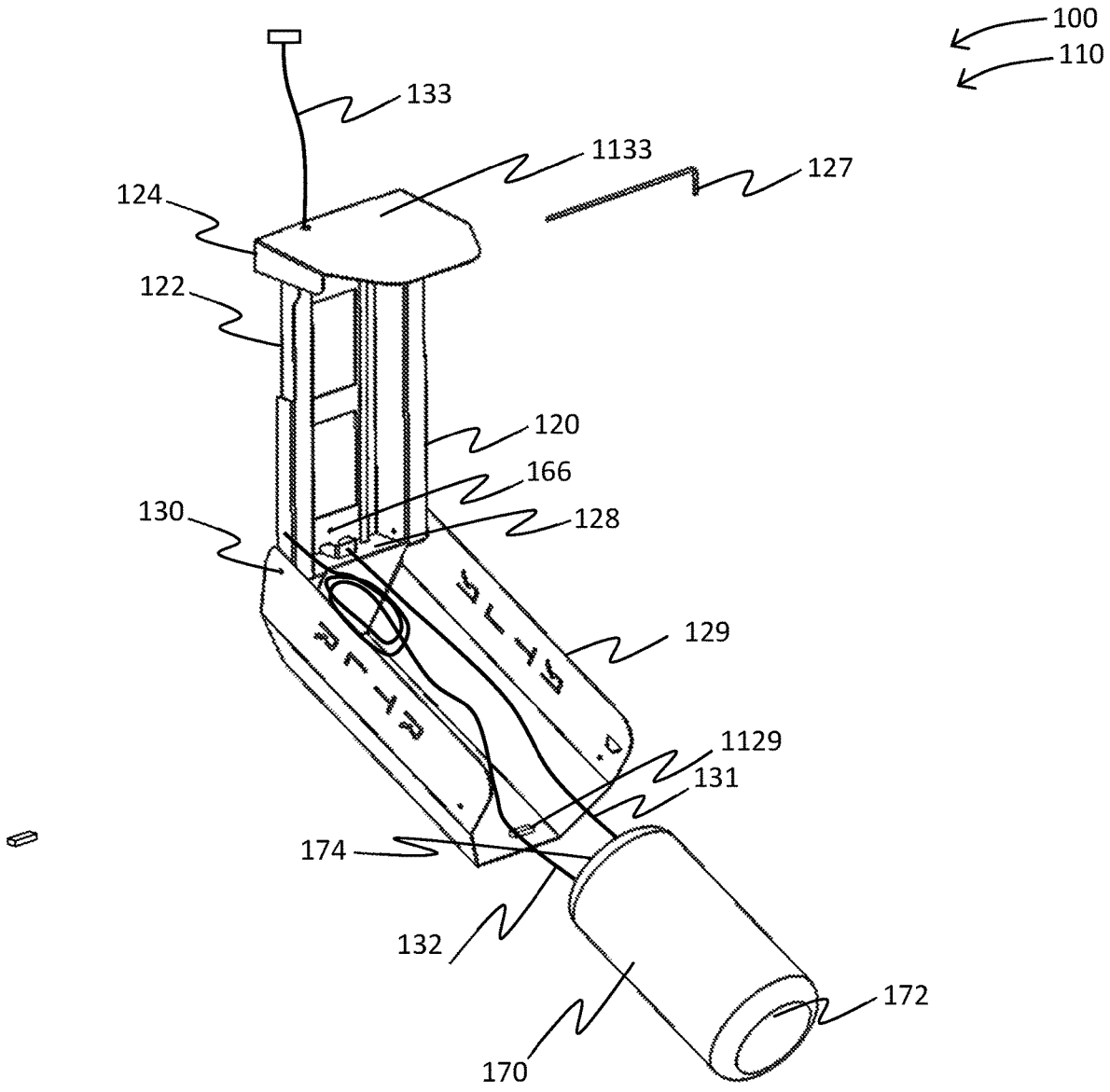
FIG. 2 is a perspective view of the life raft system of FIG. 1, according to an embodiment of the present disclosure.

FIG. 2 shows a perspective view of the life raft system 100 of FIG. 1, according to an embodiment of the present disclosure. As above, the life raft system 100 may include the life raft assembly 110 the mounting bracket 120 having the base 122, the upper lateral support 124 comprising the latching mechanism 126, and the lower lateral support 128 comprising the hinge-member 130, the self-inflatable raft 160 having the housing 170 and the inflator 164. The life raft assembly 110 is configured within a housing 170 during a ready for use condition and comprises the self-inflatable life raft 160 and the inflator 164. A first-portion 172 of the housing 170 is oriented to a top section of the cover chute 129 and upper latching point 1129 near the latching mechanism 126 and a second-portion 174 of the housing 170 is oriented to a bottom section of the cover chute 129 near the hinge-member 130. The latching mechanism 126 when released, releases the top portion of the cover chute 129 and allows the cover chute 129 to pivot about the hinge-member 130. The latching mechanism 126 may include a safety securing pin 127. The inflator 164 is activated when the inflator cable 131 is pulled by the life raft assembly 110 momentum after the life raft assembly 110 is deployed and ejected from the cover chute 129.

Figure 3:
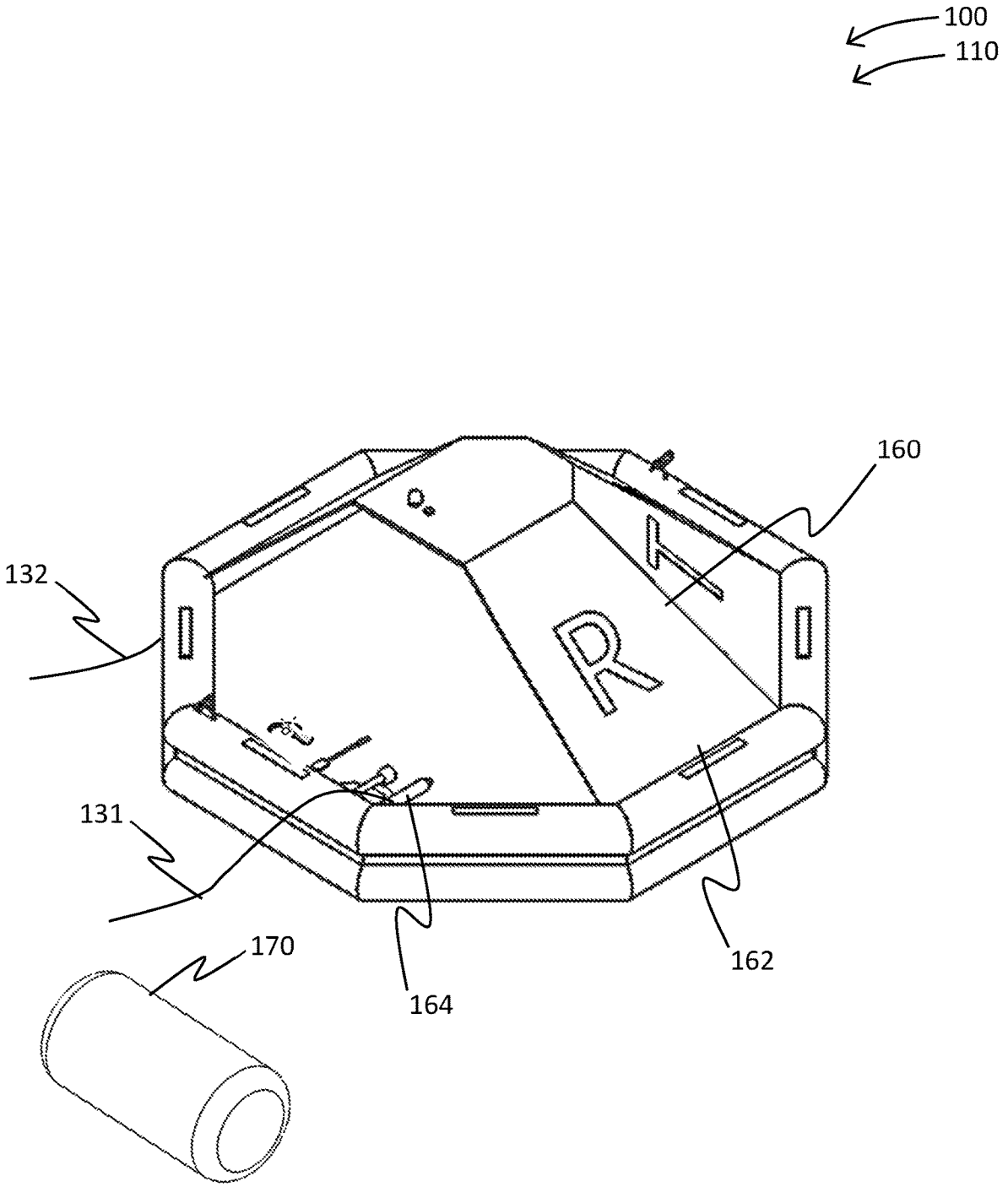
FIG. 3 is a perspective view of the life raft system of FIG. 1, according to an embodiment of the present disclosure.

FIG. 3 shows a perspective view of the life raft system 100 of FIG. 1, according to an embodiment of the present disclosure. As above, the life raft system 100 may include the life raft assembly 110. The life raft assembly 110 further comprises a housing 170, an inflator 164, an inflator cable 131, and a raft securing cable 132 enclosed between the base 122 and the cover chute 129.

The self-inflatable raft 160 is concealed within the housing 170 during non-use. Once the deployment cable 133 is pulled, it releases the latching mechanism 126 in the upper lateral support 124 of the base 122. The housing 170 comprises a carbon dioxide inflator 164 (or other suitable gas) compression release. The housing 170 is preferably flexible. Once the inflator cable 131 is pulled, the inflator 164 is activated. The inflator 164 comprises carbon dioxide inflation including a small canister. The inflator 164 when activated, inflates the self-inflatable raft 160 for use.

Figure 4:
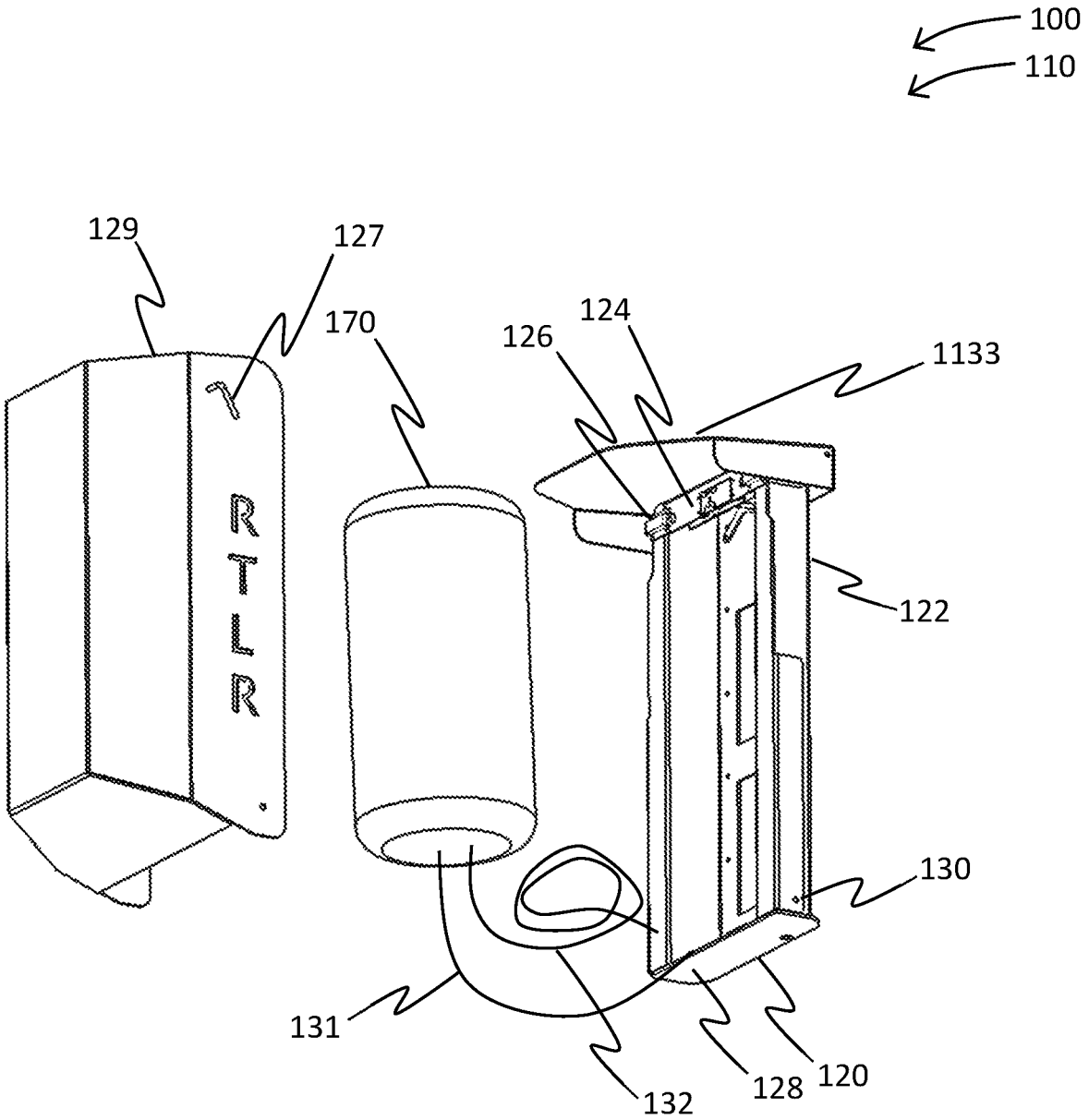
FIG. 4 is a perspective view of the life raft system of FIG. 1, according to an embodiment of the present disclosure.

FIG. 4 shows a perspective view of the life raft system 100 of FIG. 1, according to an embodiment of the present disclosure. As above, the life raft system 100 may include the life raft assembly 110, the mounting bracket 120 having the base 122, the upper lateral supports 124 comprising the latching mechanism 126, the lower lateral supports 128 comprising the hinge-member 130 and awning 1133, the self-inflatable raft 160 having the housing 170 and the inflator 164. The life raft system 100 is configured to mount to a structure 5 in an elevated position above ground. The structure 5 comprises a building-structure, home, commercial structure, work camp trailer or other structure providing families, workers or other users the ability to flee to higher ground when a disaster occurs. The life raft assembly 110 further comprises a raft securing cable 132 connecting the self-inflatable raft 160 to the mounting bracket 120. The raft securing cable 132 is connected to the mounting bracket 120 via a fastener or carabiner-clip. The raft securing cable 132 allows the self-inflatable raft 160 to stay tethered to a structure 5 if desired.

Figure 5:
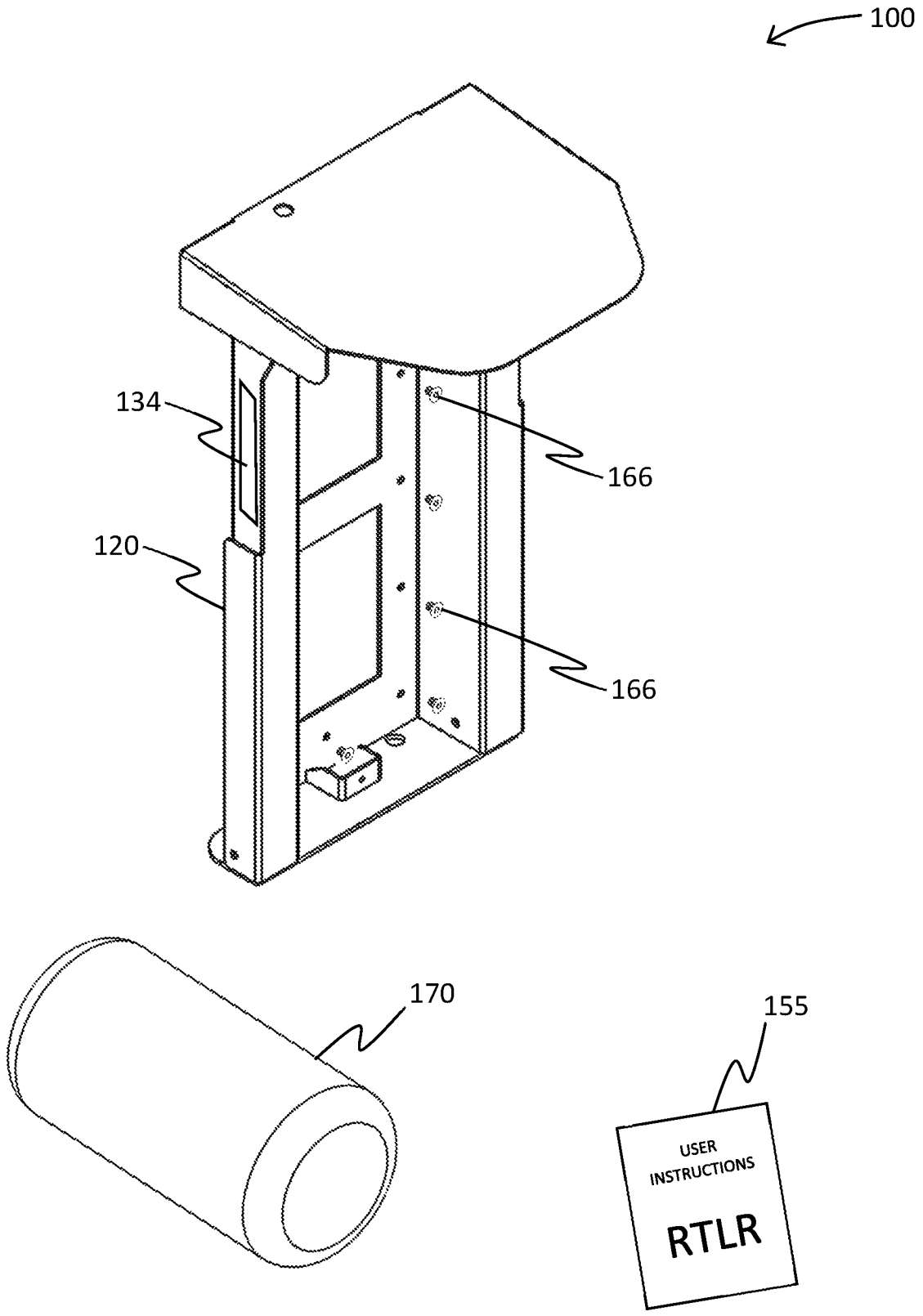
FIG. 5 is a perspective view of the life raft system of FIG. 1, according to an embodiment of the present disclosure.

Referring now to FIG. 5 showing a perspective view of the life raft system 100 of FIG. 1, according to an embodiment of the present disclosure. As above, the life raft system 100 may include the life raft assembly 110, the mounting bracket 120 and the self-inflatable raft 160. The housing 170 further encases safety-items for emergency use such as a life straw, a weather proof lighter, a whistle, and a small led flashlight. The housing 170 may comprise hard plastic and may be available in various colors for aesthetic appeal. The life raft assembly 110 may further comprise safety indicators, color indicators, or other safety markers. The life raft system 100 may also include LED lighting 134, safety indicators, color indicators, or other safety markers.

A kit is also disclosed herein including a set of instructions 155, a self-inflatable raft 160, a mounting bracket 120, and a plurality of fasteners 166.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A life raft system comprising:
a life raft assembly including;
a housing;
a self-inflatable raft;
an inflator;
an inflator cable; and
a raft securing cable;
a mounting bracket having;
a base comprising;
upper lateral supports including;
a latching mechanism comprising;
a deployment cable;
lower lateral support comprising;
a hinge member;
an awning; and
lights;
a cover chute having;
an upper latching points;
lower hinge points; and
a safety securing pin;
wherein said life raft assembly comprises said housing, said self-inflatable raft; said inflator, said inflator cable, and said raft securing cable;
wherein said mounting bracket comprises said base, said upper lateral supports, and said lower lateral supports in functional combination, and configured to mount to a structure via a plurality of fasteners;
wherein said upper lateral supports and said lower lateral supports extend from said base;
wherein said self-inflatable raft is configured within said housing and comprises said inflator, said inflator cable, and said raft securing cable;
wherein a first-portion of said housing is oriented towards an upper mounting bracket portion of said mounting bracket at said latching mechanism and a second-portion of said housing is oriented towards a lower portion of said mounting bracket at said hinge-member;
wherein said latching mechanism when released, releases an upper cover chute portion of said cover chute and allows said cover chute to pivot about said hinge-member; and
wherein said life raft assembly is deployed and said inflator when activated with said inflator cable, inflates said self-inflatable raft for use.

2. The life raft system of claim 1, wherein said life raft assembly is concealed behind said cover chute during non-use.

3. The life raft system of claim 2, wherein said cover chute is latched at said latching mechanism positioned at said upper mounting bracket portion.

4. The life raft system of claim 3, wherein said cover chute is hinged at a bottom cover chute section.

5. The life raft system of claim 1, wherein said self-inflatable raft is concealed within said housing during non-use.

6. The life raft system of claim 5, wherein said housing comprises carbon dioxide inflator compression release.

7. The life raft system of claim 6, wherein said housing is flexible.

8. The life raft system of claim 1, wherein said mounting bracket is configured to mount to a structure in an elevated position above ground.

9. The life raft system of claim 8, wherein said structure comprises a building-structure.

10. The life raft system of claim 1, wherein said life raft assembly further comprises a raft securing cable connecting said self-inflatable raft to said mounting bracket.

11. The life raft system of claim 1, wherein said latching mechanism comprises a deployment cable.

12. The life raft system of claim 1, wherein said inflator is activated when said inflator cable is pulled when said self-inflatable raft is ejected.

13. The life raft system of claim 12, wherein said inflator comprises pressurized carbon dioxide gas housed in a gas canister as an inflation means that is released by pulling said inflator cable thus releasing said pressurized carbon dioxide gas into said life raft buoyancy chambers.

14. The life raft system of claim 6, wherein said housing further encases an inflator cable and raft securing cable.

15. The life raft system of claim 14, wherein said housing further encases safety-items for emergency use.

16. The life raft system of claim 1, wherein said life raft assembly further comprises safety indicators.

17. The life raft system of claim 16, wherein said lights comprise LED lighting.

18. The life raft system of claim 1, wherein said raft securing cable is connected to said mounting bracket via a carabiner-clip.

19. A life raft system, the life raft system comprising:
a life raft assembly including;
a housing;
a self-inflatable raft;
an inflator;
an inflator cable; and
a raft securing cable;
a mounting bracket having;
a base comprising;
upper lateral supports comprising;
a latching mechanism comprising;

a deployment cable;
lower lateral support comprising;
a hinge member;
an awning; and
lights;
a cover chute having;
an upper latching points;
lower hinge points; and
a safety securing pin;
wherein said life raft system comprises said life raft assembly, said mounting bracket and said cover chute;
wherein said mounting bracket comprises said base, said upper lateral supports, and said lower lateral supports in functional combination, and configured to mount to a structure via a plurality of fasteners;
wherein said life raft assembly is concealed behind a cover chute during non-use;
wherein said upper lateral support and said lower lateral support extend from said base;
wherein said cover chute is latched at said latching mechanism positioned at said upper mounting bracket portion;
wherein said cover chute is hinged at said bottom cover chute section;
wherein said self-inflatable raft is configured within said housing and comprises said inflator, said inflator cable, and said raft securing cable;
wherein said self-inflatable raft is concealed within a housing during non-use;
wherein a first-portion of said housing is oriented towards an upper mounting bracket portion of said mounting bracket at said latching mechanism and a second-portion of said housing is oriented towards lower portion of said mounting bracket at said hinge-member;
wherein said housing further encases an inflator cable and raft securing cable;
wherein said housing further encases safety-items for emergency use;
wherein said housing comprises compressed carbon dioxide inflator release;
wherein said housing is flexible;
wherein said latching mechanism when released, releases an upper cover chute portion of said cover chute and allows said cover chute to pivot about said hinge-member;
wherein said latching mechanism comprises a deployment cable;
wherein said base is configured to mount to a structure in an elevated position above ground;
wherein said structure comprises a building-structure;
wherein said inflator when activated, inflates said self-inflatable raft for use;
wherein said inflator is activated when said inflator cable is pulled when said self-inflatable raft is ejected;
wherein said inflator comprises carbon dioxide inflation;
wherein said inflator comprises pressurized carbon dioxide gas housed in a gas canister as an inflation means that is released by pulling said inflator cable thus releasing said pressurized carbon dioxide gas into said life raft buoyancy chambers;
wherein said life raft assembly further comprises a raft securing cable connecting said self-inflatable raft to said mounting bracket;
wherein said raft securing cable is connected to said mounting bracket via a carabiner-clip or fasteners;
wherein said life raft system further comprises safety indicators;
wherein said life raft assembly further comprises safety indicators;
wherein said lights comprise LED lighting.

20. The life raft system of claim 19, further comprising set of instructions; said self-inflatable raft; said mounting bracket; said cover chute; said plurality of cables; said latch; said hinge; said lighting; said plurality of fasteners and wherein the life raft system is arranged as a kit.

* * * * *